US005187492A

United States Patent [19]

Sato

[11] Patent Number: 5,187,492

[45] Date of Patent: Feb. 16, 1993

[54] STRUCTURE FOR MOUNTING TELESCOPIC ANTENNA FOR AUTOMOBILE

[75] Inventor: Masaei Sato, Nitta, Japan

[73] Assignee: Mitsuba Electric Manufacturing Co., Ltd., Gunma, Japan

[21] Appl. No.: 723,378

[22] Filed: Jun. 28, 1991

[30] Foreign Application Priority Data

Jul. 3, 1990 [JP] Japan ..... 2-070749
Jul. 3, 1990 [JP] Japan ..... 2-070751

[51] Int. Cl.[5] ..... H01Q 1/10
[52] U.S. Cl. ..... 343/901; 343/903
[58] Field of Search ..... 343/702, 715, 717, 903, 343/900

[56] References Cited

U.S. PATENT DOCUMENTS

| | | | |
|---|---|---|---|
| 2,365,886 | 12/1944 | Lehmann | 343/903 |
| 2,366,634 | 1/1945 | Ludwig | 343/903 |
| 4,200,874 | 4/1980 | Harada | 343/715 |
| 4,353,075 | 10/1982 | Edwards | 343/903 |
| 4,525,718 | 6/1985 | Imazeki et al. | 343/702 |
| 4,527,168 | 7/1985 | Edwards | 343/901 |
| 5,072,230 | 12/1991 | Taniyoshi et al. | 343/903 |

FOREIGN PATENT DOCUMENTS

| | | | |
|---|---|---|---|
| 2246985 | 5/1975 | France | 343/901 |

*Primary Examiner*—Michael C. Wimer
*Assistant Examiner*—Tan Ho
*Attorney, Agent, or Firm*—Oliff & Berridge

[57] ABSTRACT

The first structural aspect for mounting a telescopic antenna for an automobile includes a nut surrounding the top end portion of a spacer pipe and engaging with a threaded portion cut on the outside of the top end portion of a base pipe; a flange and a collar provided on a conducting pipe and the spacer pipe respectively and clamped between a contact portion provided on the nut and the top rim of the base pipe; and a flat ring positioned between the flange and the collar. The second structural aspect for mounting a telescopic antenna for an automobile includes resilient protrusions defined on the spacer pipe; holes defined on the conducting pipe, for engaging with the resilient protrusions when the spacer pipe is inserted in the conducting pipe so that the spacer pipe can be kept in position; and a portion around the resilient protrusions having an inside diameter greater than that of the spacer pipe. Both aspects help secure easy sliding of the antenna rods.

6 Claims, 3 Drawing Sheets

STRUCTURE FOR MOUNTING TELESCOPIC ANTENNA FOR AUTOMOBILE

BACKGROUND OF THE INVENTION

1. Field of the Invention

The present invention relates to a structure for mounting a telescopic antenna for an automobile, such as a passenger car.

2. Description of Related Art

The antennas for automobiles are generally structured by telescopic-jointed rods, free to extend and contract. This kind of antenna is mounted as follows. As shown in FIG. 5, a spacer pipe 24 is monolithically fitted in a conducting pipe 23, an outermost rod 2*c* is slidably fitted in and supported by the spacer pipe 24, a base pipe 27 is monolithically fitted over the conducting pipe 23, and a nut 28 is fastened onto a threaded portion 27*a* of the base pipe 27. In this structure, the conducting pipe 23 and the spacer pipe 24 have to be connected rigidly but nonconductingly by fastening the nut 28. Therefore, in a conventional structure, a flange 23*a* and a collar 24*a* provided on the pipes 23, 24 are clamped by the top rim of the base pipe 27 and a contact portion 28*a* of the nut 28. The flange 23*a* of the conducting pipe 23 has a round surface since it is shaped by expanding the rim portion. In short, the spacer pipe's collar 24*a* bears directly against the round flange 23*a*. Consequently, when the spacer pipe's collar 24*a* is deformed by fastening the nut 28 too tightly, the plastic deformation is directed inwards along the round surface of the flange 23*a*, narrowing the spacer pipe 24. In this case, the friction between the outermost rod 2*c* and the spacer pipe 24 becomes greater and the sliding of the outmost rod 2*c* will be hindered.

The spacer pipe 24 has to be fitted in the conducting pipe 23 and attached in position so as not to come off. In a usual method for attaching, the conducting pipe 23 with the spacer pipe 24 fitted in is processed by embossing or curl staking so that the processed part engages with the recessed portion 24*b* of the spacer pipe 24. Not only is the process complicated and labor-consuming, but the pipes may deform, with the circularity decreasing, or even break under the process load. Again, the easy sliding of the outermost rod will thus be hindered. Or, in this method, insufficient or not-deep-enough insertion of the spacer pipe into the conducting pipe may occur, and then the insufficiently assembled pipes may go into the process for attaching the spacer pipe 24 in position.

SUMMARY OF THE INVENTION

The present invention is to provide a structure for mounting a telescopic antenna for an automobile, wherein the above-described problems are solved.

The first structural aspect of this invention for mounting an antenna having a plurality of rods of different diameters telescopically joined so as to freely extend and contract, comprises:

a conducting pipe made of metal, loosely fitted over the antenna and provided with a contact part electrically contacting the outermost, widest rod;

a spacer pipe monolithically fitted in the conducting pipe, slidably surrounding and supporting the outermost rod;

a base pipe monolithically fitted over the conducting pipe and supporting the conducting pipe;

a nut surrounding the top end portion of the spacer pipe and engaging with a threaded portion cut on the outside of the top end portion of the base pipe;

a flange and a collar provided on the conducting pipe and the spacer pipe respectively and clamped between a contact portion provided on the nut and the top rim of the base pipe; and a flat ring positioned between the flange and the collar.

The second structural aspect of this invention for mounting an antenna having a plurality of rods of different diameters telescopically jointed so as to freely extend and contract, comprises:

a conducting pipe made of metal, loosely fitted over the antenna and provided with a contact part electrically contacting the outermost, widest rod;

a spacer pipe monolithically fitted in the conducting pipe, slidably surrounding and supporting the outermost rod;

resilient protrusions defined on the spacer pipe;

holes defined on the conducting pipe, for engaging with the resilient protrusions when the spacer pipe is inserted in the conducting pipe so that the spacer pipe can be kept in position; and a portion around the resilient protrusions having an inside diameter greater than that of the other portion of the spacer pipe.

In this structure, the plastic deformation of the spacer pipe's collar will not be directed inwards when the nut is fastened too tightly. As for attaching the spacer pipe in position, the engaging parts on the pipes are shaped before assembling. Both improvements will secure the easy sliding of the antenna rods.

When the antenna is mounted in this structure with: a nut surrounding the top end portion of the spacer pipe and engaging with a threaded portion cut on the outside of the top end portion of the base pipe; a flange and a collar provided on the conducting pipe and the spacer pipe respectively and clamped between a contact portion provided on the nut and the top rim of the base pipe; and a flat ring positioned between the flange and the collar, the spacer pipe's collar, made of plastic, bears against a parallel surface of the flat ring instead of a round surface of the conducting pipe's flange as in a conventional structure. Consequently, when the nut is fastened too tightly, the collar is plastically deformed outwards while, conventionally, the plastic deformation goes inwards along the round surface of the flange, narrowing the inside opening of the spacer pipe thereof. The flat ring in this invention eliminates the possibility of narrowing the spacer pipe or increasing the friction between the outermost rod and the spacer pipe, so as to secure the easy sliding of the antenna rods.

As for attaching the spacer pipe in position in the conducting pipe in the structure with: resilient protrusions defined on the spacer pipe; holes defined on the conducting pipe for engaging with the resilient protrusions when the spacer pipe is inserted in the conducting pipe so that the spacer pipe can be kept in position; and a portion around the resilient protrusions having an inside diameter greater than that of the other portion of the spacer pipe, the only work necessary during the assembly is to insert the spacer pipe into the conducting pipe until the resilient protrusions engage with the holes. The resilient protrusions on the spacer pipe and the holes on the conducting pipe are provided beforehand. The conventional process applied onto the conducting pipe with the fitted-in spacer pipe for attaching the spacer pipe in position is eliminated, and the assembly efficiency is greatly improved. Also, the conducting and spacer pipes escape the deformation or the breakage which may occur under the conventional process. Thus, the easy sliding of the outermost rod is secured again.

The design of the spacer pipe is effective in that the inside diameter of the portion around the resilient protrusions is greater than that of the other portion. When the spacer pipe is inserted in the conducting pipe in the wrong position, the engagement of the resilient protrusions and the holes fail, and the resilient protrusions are forced to bend inwards. Even if such a case happens for some reason, the resilient protrusions will never affect the outermost rod since the difference of the inside diameters provides some room for the inward bending of the resilient protrusions. The resilient protrusions for keeping the spacer pipe in position never hinder the easy sliding of the outermost rod.

BRIEF DESCRIPTION OF THE DRAWINGS

The drawings illustrate a preferred embodiment of a telescopic antenna for a vehicle according to the present invention, wherein.

DESCRIPTION OF THE PREFERRED EMBODIMENTS

Figure 1:
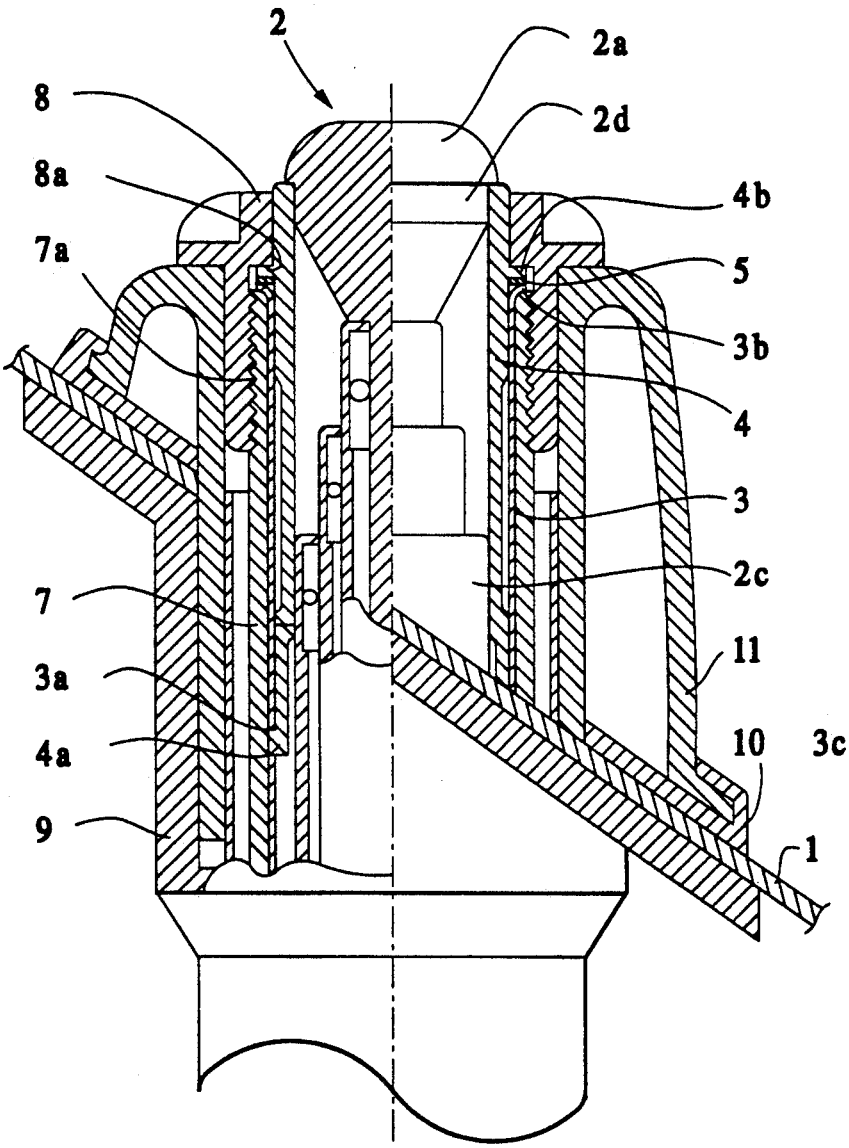
FIG. 1 is a sectional view of the antenna.

With reference to the figures, an antenna 2 is installed on an automobile body 1. The antenna 2 is composed of a plurality of slidably jointed rods (four rods in an embodiment) in telescopic joint structure so that the antenna 2 is free to extend and contract. A cap 2*a* on the tip of the first rod 2*b*, the narrowest rod, is provided with a fit-in portion whose diameter is the same as the outside diameter of an outermost rod 2*c*, the widest rod.

A conducting pipe 3 made of conductive material has a diameter a little greater than the outside diameter of the outermost rod 2*c*. A spacer pipe 4 made of nonconducting material such as synthetic resin is fitted in an upper portion of the conducting pipe 3. The spacer pipe 4 has engaging resilient protrusions 4*a* at the lower end and a collar 4*b* on the outside near the upper rim. The conducting pipe 3 has a flange 3*b* which is roundly shaped by expanding the upper rim and notched engaging holes 3*a*. The spacer pipe 4 is inserted into the conducting pipe 3 from the upper opening until the collar 4*b* of the spacer pipe 4 contacts the flange 3*b* of the conducting pipe 3. Here, the resilient protrusions 4*a* engage with the holes 3*a* to keep the spacer pipe 4 in position. A flat ring 5 is provided between the contact surfaces of the collar 4*b* and the flange 3*b*. The outermost rod 2*c* is slidably fitted in the pipe spacer 4. The fit-in portion 2*d* of the cap 2*a* fits in the upper opening of the spacer pipe 4 when the antenna is contracted in.

Figure 4A:
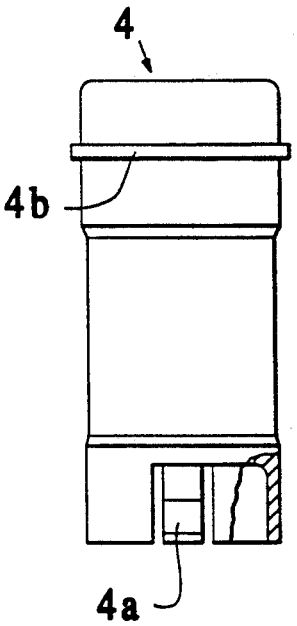
FIGS. 4A, 4B and 4C are an elevation, a partial sectional side elevation and a bottom view of the spacer pipe.
Figure 4B:
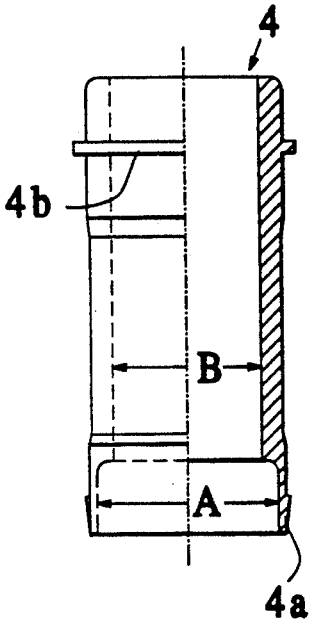
Figure 4C:
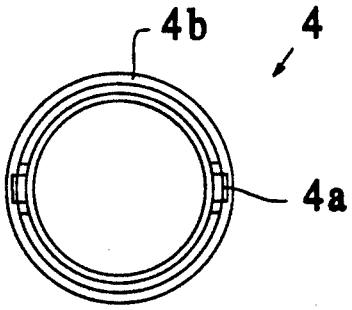
Figure 5:
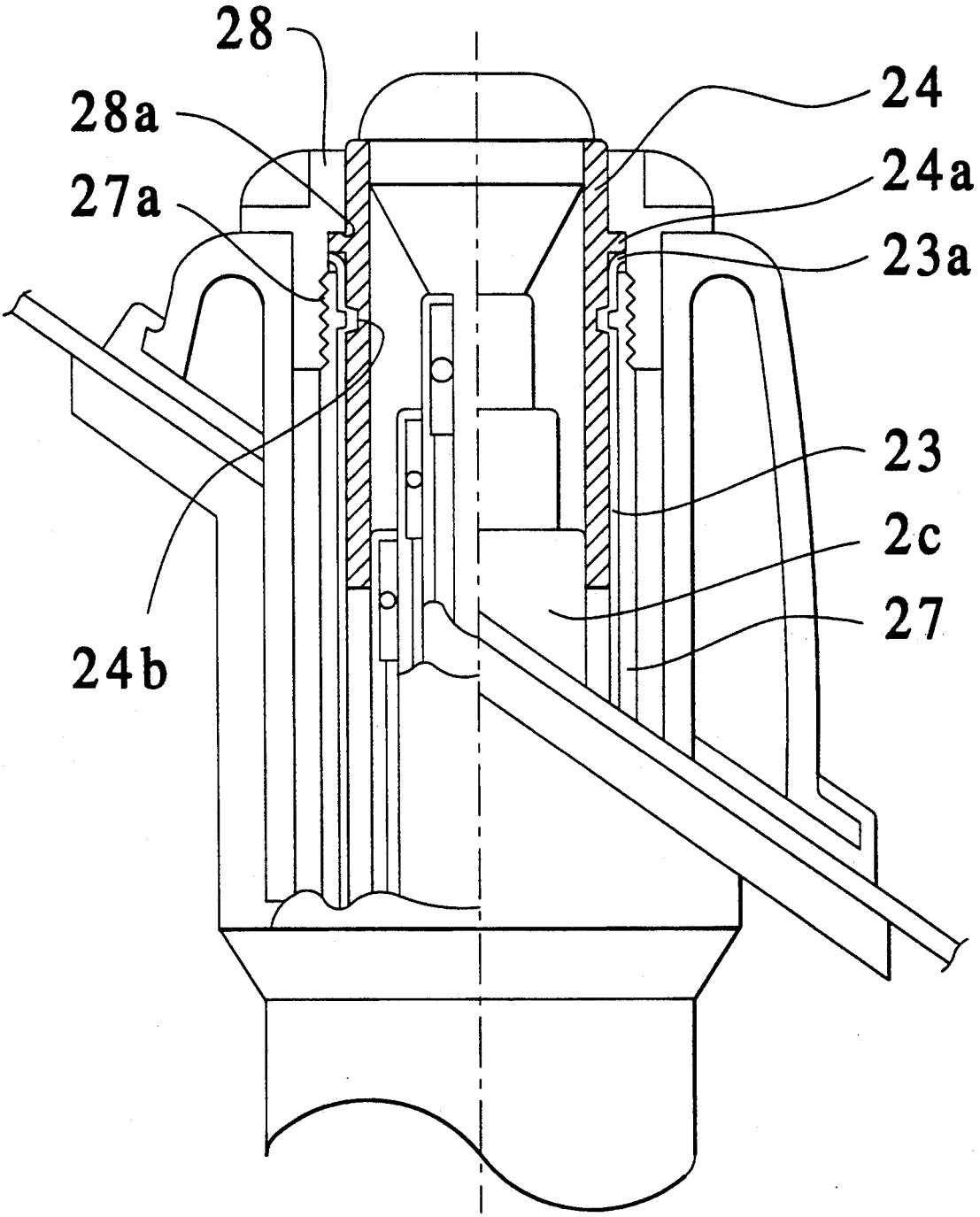
FIG. 5 PRIOR ART
FIG. 5 is a sectional view of a related antenna.

In the spacer pipe 4, as shown in FIG. 4*b*, the inside diameter A of the portion around the resilient protrusions 4*a* is greater than the inside diameter B of the other portion. The portion including the resilient protrusions 4*a* remains off the outside of the outermost rod 2*c*.

Figure 2:
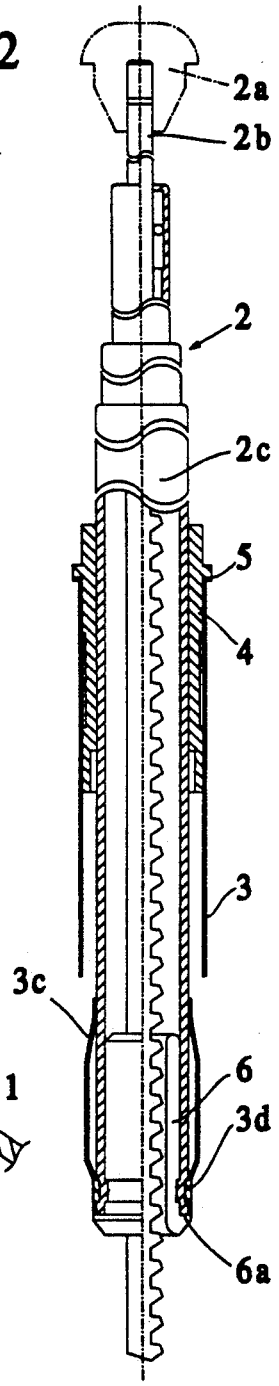
FIG. 2 is a partial sectional view of the antenna when extended.
Figure 3:
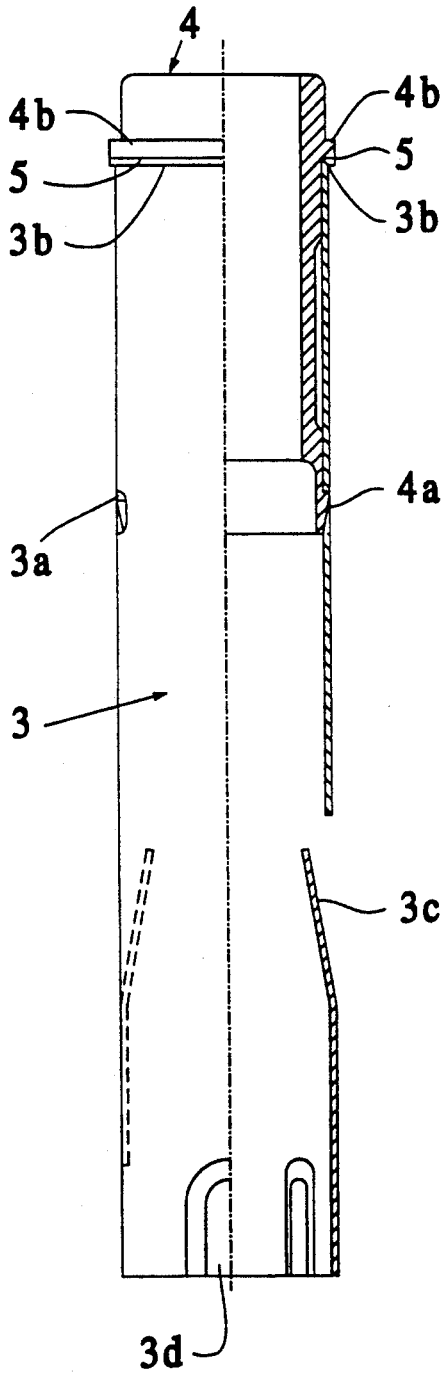
FIG. 3 is a partial sectional elevation of the spacer pipe and the conducting pipe.

In conducting pipe 3, shown in FIGS. 2, 3, there are contact parts 3*c* notched at a part lower than the bottom of the spacer pipe 4. The contact parts are bent inwards so as to contact slidably and electrically with the outside of the outermost rod 2*c*. There is a plurality of squeezed parts 3*d* (three parts in the preferred embodiment) shaped at the bottom of the conducting pipe 3. There is a stopper piece 6 monolithically fitted in the bottom portion of the outermost rod 2*c*. When the antenna 2 is fully extended, the squeezed parts 3*d* bear against a radial projection 6*a* of the stopper piece 6 so as to stop the antenna 2 from coming off.

Referring to FIG. 1, a base pipe 7 is fitted over the conducting pipe 3. The top rim of the base pipe 7 bears against the conducting pipe's flange 3*b*. The outside of the top portion 7*a* is threaded so as to engage with a nut 8. The nut 8 has a contact portion 8*a* which bears against the top surface of the spacer pipe's collar 4*b*. Structured as above, the conducting pipe's flange 3*b* and the spacer pipe's collar 4*b* with the flat ring 5 therebetween are clamped by fastening the nut 8 onto the threaded portion 7*a* of the base pipe 7.

Reference Nos. 9, 10 and 11 are a ground, waterproof rubber and an insulate cap respectively.

In the embodiment of this invention, as described above, the top rim of the base pipe 7 and the contact portion 8*a* of the nut 8 fastened onto the threaded portion 7*a* clamp the spacer pipe's collar 4*b* and the base pipe's flange with the flat ring 5 interpositioned. The flat ring 5 provides the parallel counter surface for the collar 4*b* to bear against while, in a conventional structure without a flat ring 5, a collar 4*b* bears directly against a rounded flange 3*b*. When clamped too tightly, the collar 4*b* plastically deforms outwards along the flat ring 5 while, conventionally, the deformation goes inward along a rounded flange 3 and narrows a spacer pipe 4. Consequently, the flat ring eliminates the possibility of narrowing the spacer pipe 4 and ensures the easy sliding of the outermost rod 2*c*.

In order to keep the spacer pipe 4 in the conducting pipe 3, the spacer pipe 4 only has to be inserted into the conducting pipe 3 from the top opening and thrust until the resilient protrusions 4*a* engage with the holes 3*a*. In this way, the spacer pipe 4 remains in position.

In mounting the antenna 2, the only work necessary for stopping the spacer pipe 4 in position is to insert the spacer pipe 4 into the conducting pipe 3 until the resilient protrusions 4*a* and the holes 3*a* engage, for both of the parts are provided beforehand. This structure of the invention eliminates the conventional labor-consuming process applied to the conducting pipe with the fitted-in spacer pipe for attaching the spacer pipe 4 in position, substantially increasing the assembly efficiency. Also, in this method, the spacer pipe 4 and the conducting pipe 3 are free from the deformation or breakage occasionally happening in the conventional process. That, again, secures the easy sliding of the outermost rod 2*c*.

The design of the spacer pipe 4, wherein the inside diameter A of the portion around the resilient protrusions 4*a* is greater than the inside diameter B of the other portion, also helps. If the spacer pipe 4 is inserted in the conducting pipe 3 in the wrong position, the engagement of the resilient protrusions 4*a* and the holes 3*a* fail and the resilient protrusions 4*a* are forced to bend inwards. Even in this case, the resilient protrusions 4*a* will never affect the outermost rod 2*c* since the difference of the inside diameters (A − B) provides some room for the inward bending of the resilient protrusions 4a. The resilient protrusions 4a for keeping the spacer pipe 4 in position never hinder the easy sliding of the outermost rod 2c.

For efficient processing, a hole 3a and a contact part 3c in the conducting pipe 3 may be aligned on the same straight line, so that both parts can be stamped at the same time.

What is claimed is:

1. A structure for mounting a telescopic antenna for an automobile, said antenna having a plurality of rods of different diameters telescopically jointed so as to freely extend and contract, comprising:

a conducting pipe made of metal, loosely fitted over said antenna and provided with a contact part electrically contacting an outermost, widest rod;

a spacer pipe monolithically fitted in said conducting pipe, slidably surrounding and supporting said outermost rod;

a base pipe monolithically fitted over and supporting said conducting pipe;

a nut surrounding a top end portion of said spacer pipe and engaging with a threaded portion cut on an outside surface of the top end portion of said base pipe;

a flange and a collar provided on said conducting pipe and said spacer pipe respectively and clamped between a contact portion provided on said nut and a top rim of said base pipe; and a flat ring positioned between said flange and said collar.

2. A structure for mounting a telescopic antenna for an automobile, said antenna having a plurality of rods of different diameters telescopically jointed so as to freely extend and contract, comprising:

a conducting pipe made of metal, loosely fitted over said antenna and provided with a contact part electrically contacting an outermost, widest rod, said conducting pipe having a plurality of holes therein;

a spacer pipe monolithically fitted in said conducting pipe, slidably surrounding and supporting said outermost rod, the spacer pipe having first and second portions;

resilient protrusions projecting from said first portion of said spacer pipe for engaging with said plurality holes when said spacer pipe is inserted in said conducting pipe to maintain said spacer pipe in position; and said first portion with said resilient protrusions having an inside diameter greater than an inside diameter of said second portion of said spacer pipe.

3. A mounting for a telescopic antenna having a plurality of different diameter rods telescopically jointed together for extension and contraction, comprising:

a metal conducting pipe surrounding said antenna and being in electrical contact with an outermost rod of said antenna, said conducting pipe having a flange;

a spacer pipe fitted in said conducting pipe and slidably surrounding said outermost rod, said spacer pipe having a collar defining a top end portion to one side of said collar;

a base pipe fitted over and supporting said conducting pipe, the base pipe having a top rim and an externally threaded top end portion;

a nut surrounding the top end portion of the spacer pipe and engaging the externally threaded top end portion of the base pipe for clamping said flange on said conducting pipe and said collar on said spacer pipe between said nut and said top rim of said base pipe; and deflection means positioned between said flange and said collar for directing deformation of said spacer pipe away from said outermost rod.

4. The mounting of claim 3 wherein the deflection means is a flat ring having a surface parallel to a surface of said collar of said spacer pipe such that said surface of said flat ring directs deformation of said collar radially outward away from said outermost rod.

5. A mounting for a telescopic antenna having a plurality of different diameter rods telescopically jointed together for extension and contraction, an outermost rod having a largest diameter in relation to other rods in said plurality of rods, said mounting comprising:

a conducting pipe surrounding said antenna and being in electrical contact with said outermost rod of said antenna;

a spacer pipe fitted in said conducting pipe and slidably surrounding said outermost rod, said spacer pipe having first and second portions, a plurality of resilient protrusions being projecting from said first portion of said spacer pipe for radially inward elastic deflection upon insertion of said spacer pipe into said conducting pipe;

said conducting pipe having a plurality of holes in positions corresponding to positions of said resilient protrusions on said spacer pipe, said resilient protrusions deflecting elastically radially outwardly upon alignment of said resilient protrusions with said holes for maintaining said spacer pipe in position within said conducting pipe;

said first portion of said spacer pipe having an inside diameter greater than an inside diameter of said second portion of said spacer pipe.

6. The mounting of claim 5 wherein said inside diameter of said first portion is greater than said largest diameter of said outermost rod.

* * * * *